US007056558B2

(12) United States Patent
Daniels et al.

(10) Patent No.: US 7,056,558 B2
(45) Date of Patent: Jun. 6, 2006

(54) FABRIC SHOE OUTSOLE MANUFACTURING METHODS BY ELECTROSTATIC FLOCKING

(75) Inventors: Paul W. Daniels, Bellevue, WA (US); Tsun-Jung Huang, Bellevue, WA (US)

(73) Assignee: The Topline Corporation, Bellevue, WA (US)

( * ) Notice: Subject to any disclaimer, the term of this patent is extended or adjusted under 35 U.S.C. 154(b) by 117 days.

(21) Appl. No.: 10/660,363

(22) Filed: Sep. 10, 2003

(65) Prior Publication Data

US 2004/0163283 A1 Aug. 26, 2004

Related U.S. Application Data

(63) Continuation-in-part of application No. 10/374,679, filed on Feb. 24, 2003, now abandoned.

(51) Int. Cl.
*B05D 1/04* (2006.01)
*B05D 1/14* (2006.01)

(52) U.S. Cl. ..... 427/465; 427/462; 427/464

(58) Field of Classification Search ..... 427/462, 427/464, 465

See application file for complete search history.

(56) References Cited

U.S. PATENT DOCUMENTS

| | | | | |
|---|---|---|---|---|
| 3,020,169 | A | 2/1962 | Phillips, Jr. et al. | 117/33 |
| 3,022,188 | A | 2/1962 | Griswold | 117/25 |
| 3,073,715 | A | 1/1963 | Griswold | 117/25 |
| 3,516,102 | A | 6/1970 | Moshier | 12/142 |
| 3,711,969 | A | 1/1973 | Weinstein et al. | 36/68 |
| 3,798,048 | A * | 3/1974 | Brody et al. | 427/462 |
| 3,802,951 | A | 4/1974 | Mitchell | 161/162 |
| 4,287,629 | A | 9/1981 | Stalteri | 12/142 |
| 4,356,643 | A | 11/1982 | Kester et al. | 36/59 C |
| 4,857,377 | A | 8/1989 | Daimon et al. | 428/90 |
| 4,899,411 | A * | 2/1990 | Johnson et al. | 12/142 R |
| 5,290,607 | A * | 3/1994 | Chitouras | 427/462 |
| 6,430,844 | B1 | 8/2002 | Otis | 36/59 |
| 6,464,907 | B1 | 10/2002 | Gross | 264/21 |

FOREIGN PATENT DOCUMENTS

| | | |
|---|---|---|
| CN | 98234514.3 | 11/1999 |
| GB | 1018938 | 2/1966 |
| GB | 2 201 082 A | 8/1988 |
| JP | 51-134256 | 11/1976 |
| JP | 52-12252 | 1/1977 |

(Continued)

OTHER PUBLICATIONS

Drehle, Dutch, The Fuzzy Print—Understanding the Flocking Process; http://www.images-magazine.com/flocking.htm [Accessed May 23, 2003].

(Continued)

*Primary Examiner*—Fred J. Parker
(74) *Attorney, Agent, or Firm*—Seed IP Law Group PLLC

(57) ABSTRACT

A shoe having a fabric outsole and method for manufacturing are disclosed. In described embodiments, a shoe outsole with a bottom surface wherein an adhesive is applied to at least a portion of the bottom surface of the shoe outsole and a plurality of fibers are embedded within the adhesive. In the described method embodiment, once the adhesive is applied to the outsole, fibers are sifted down through an electrostatic field onto the adhesive. Once sufficient fibers have been embedded, the adhesive is cured and then cooled.

10 Claims, 5 Drawing Sheets

FOREIGN PATENT DOCUMENTS

| | | |
|---|---|---|
| JP | 57-203402 | 12/1982 |
| JP | 59-362 | 1/1984 |
| JP | 3-143402 | 6/1991 |
| JP | 3-170101 | 7/1991 |

OTHER PUBLICATIONS

Kim, Yong K., "Scientific Study of Flock Materials and the Flocking Process," 1997.

* cited by examiner

FABRIC SHOE OUTSOLE MANUFACTURING METHODS BY ELECTROSTATIC FLOCKING

CROSS-REFERENCE TO RELATED APPLICATION

This application is a continuation-in-part of U.S. patent application Ser. No. 10/374,679, filed Feb. 24, 2003, now abandoned, which is incorporated herein by reference in its entirety.

BACKGROUND OF THE INVENTION

1. Field of the Invention

The present invention relates to a shoe outsole where at least a portion of the outsole has fibers embedded therein, and to methods of manufacturing same.

2. Description of the Related Art

Fabric outsoles are known in slippers, for example, which are typically constructed with a fabric backed foam outsole or a midsole board inserted between the shoe upper and lower fabric sections. Fabric outsoles are also disclosed in U.S. Pat. No. 6,430,844 in which a fabric layer fabric is molded in a common mold in situ with a backing layer constituting a rubber or plastic material. Although these uses suggest that desirable results may be achieved with the prior art methods, the methods are of limited use and often require specially designed molds and a time consuming manufacturing process.

BRIEF SUMMARY OF THE INVENTION

The present invention relates to a shoe outsole where at least a portion of the bottom surface of the shoe outsole has fibers embedded into adhesive, and toward a method of applying the fibers to the shoe outsole. In the embodiments described herein, the resulting product of the present invention is a shoe where at least a portion of the bottom surface of the shoe outsole has a fiber surface. The method of applying the fibers according to the embodiments described herein consists of masking off at least a portion of a bottom surface of the shoe outsole, applying adhesive to the remaining portion of the bottom surface, and placing the shoe outsole on a support plate with the adhesive side facing upward. The support plate is placed underneath a conductive screen. An electric field is created between the conductive screen and the support plate by applying power to the conductive screen. Located above the conductive screen is a sifter device with fibers such as textile fibers, for example, placed therein. As the sifter device is actuated, the fibers gravitate toward the conductive screen and upon passing through the screen the textile fibers become charged. The fibers further advance through the electric field and become embedded in the adhesive previously applied to the outsoles. After a sufficient number of fibers have become embedded in the outsoles, the outsoles are then heated to cure the adhesive.

The process of applying the fibers to the bottom of a shoe is inexpensive and does not require any special molds or special procedures for affixing the outsole to the shoe during shoe production. Textile fibers or other substances that can be separated into thread-like structures can be used, as desired. Additionally, the present invention is not limited to a certain type of shoe outsole and thereby may be accomplished on a wide variety of shoe types such as dress shoes, women's high-heeled shoes, loafers, etc. The present invention provides shoe designers and retailers a larger variety of options for point-of-sale displays and presents an aesthetically pleasing shoe with the appearance and impression of value.

DETAILED DESCRIPTION OF THE INVENTION

The present invention is generally directed toward a shoe outsole where at least a portion of the bottom surface of the shoe outsole contains fibers embedded into adhesive, and toward a method of applying the textile fibers to the shoe outsole. The embodiments described herein permit a high degree of flexibility in applying fibers either to the entire bottom surface of the shoe outsole, for example, or to only a selected portion of the bottom surface. Textile fibers may be used or other substances that can be separated into thread-like structures can be used as desired. Further, the bottom surface of the shoe outsole may vary in texture from smooth to slightly ribbed for better traction, or to a more aggressive tread. The present invention provides retailers enhanced point-of-sale display options with a shoe that has both a visually appealing upper portion as well as a visually appealing bottom surface. Many specific details of the present invention are set forth in the embodiments described and illustrated herein to provide an understanding of the invention. One skilled in the art, however, will understand that the present invention may have additional and alternative embodiments, or may be practiced without several of the details described in the following description.

Figure 1:
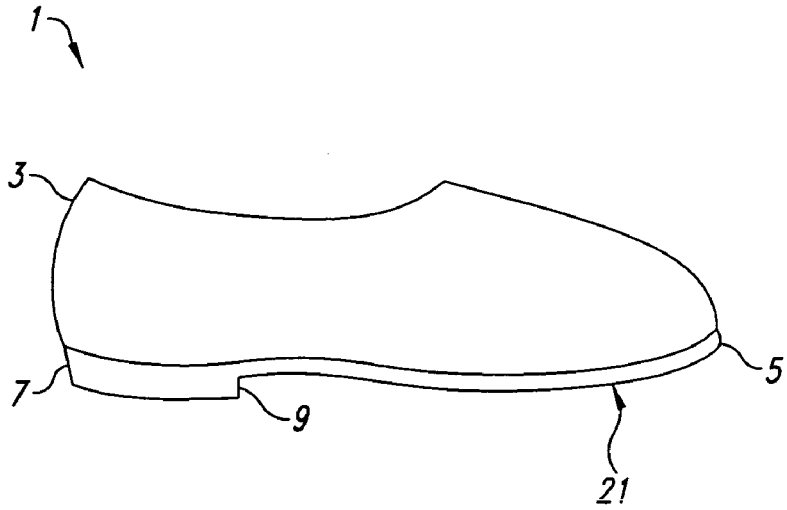
FIG. 1 is an isometric view of a type of shoe with an outsole according to one embodiment of the present invention.

FIG. 1 illustrates a typical shoe 1 incorporating a shoe upper 3 and a shoe outsole 5, the shoe outsole 5 having a top surface (not shown) and a bottom surface 21. The typical shoe 1 may be configured to have a heel 7 wherein the horizontal portion of the heel may be considered to form part of the bottom surface 21 of the shoe outsole 5. The present invention may also be practiced other portions of the outsole in the same manner as will be described for the bottom surface 21 of the shoe outsole 5.

Figure 2:
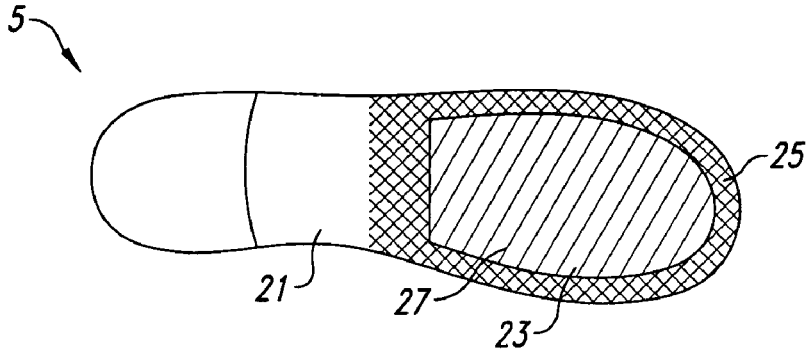
FIG. 2 is a plan view of the bottom surface of the shoe outsole of FIG. 1.

FIG. 2 illustrates the bottom surface 21 of the shoe outsole 5. The shoe outsole 5 may be made from a variety of different materials such as fiber reinforced composite material, polyvinyl chloride (PVC), thermoplastic rubber (TPR), rubber, or ethylene vinyl acetate (EVA), for example. The bottom surface 21 of the shoe outsole 5 may have a first region 23 and a second region 25. The first region 23 may be configured to accept the fibers 29 (FIG. 5) while the second region 25 may be masked off to prevent any fibers 29 (FIG. 5) from attaching thereto. The second region 25 would typically be masked off before any adhesive 27 or fibers 29 (FIG. 4) are applied to the shoe outsole 5. However, it is not necessary that any portion of the bottom surface 21 be masked off such that the adhesive 27 and subsequently the fibers 29 (FIG. 4) may be applied to the entire bottom surface 21.

The fibers 29 (FIG. 5) can have a length in the range of 0.2 to 1.0 millimeters. The shorter fibers, e.g., 0.2 mm length, may give the treated outsole 5 a grainy, almost sandpaper type look and feel. It may be preferable to apply the shorter fibers to athletic type shoes. Conversely, the longer fibers may be selected for dressier shoes like pumps. The length of the fibers may affect the amount of slippage between the bottom surface 21 of the outsole 5 and a walking surface. The inventors appreciate those fibers having a length greater than 1.0 mm may be used, but are not preferred for aesthetic purposes. In addition, the fibers 29 (FIG. 5) can be made out of synthetic textile material such as rayon and nylon or a natural textile material such as cotton.

Figure 3:
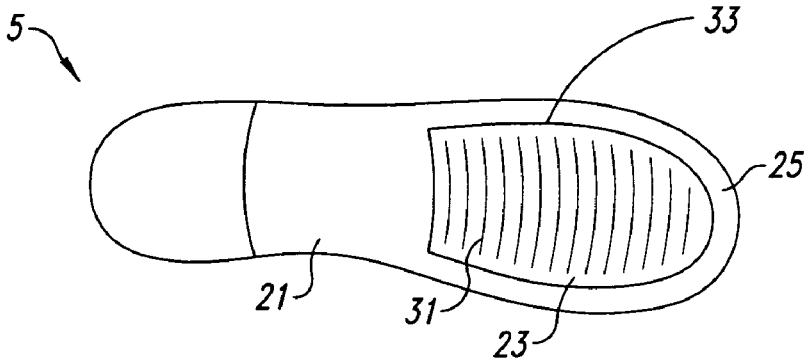
FIG. 3 is plan view of the bottom surface of the shoe outsole of FIG. 1 according to a second embodiment of the present invention.

FIG. 3 illustrates a variation of the present invention. At least a portion of the bottom surface 21 may have a tread region 31 such as ribs, flanges, or some other surface effect which gives the shoe 1 a more aggressive tread. For purposes of the present invention, the bottom surface 21 is deemed to include all of the surfaces making up any portion of the tread region 31 such as the vertical surfaces of any ribs or flanges.

Figure 4:
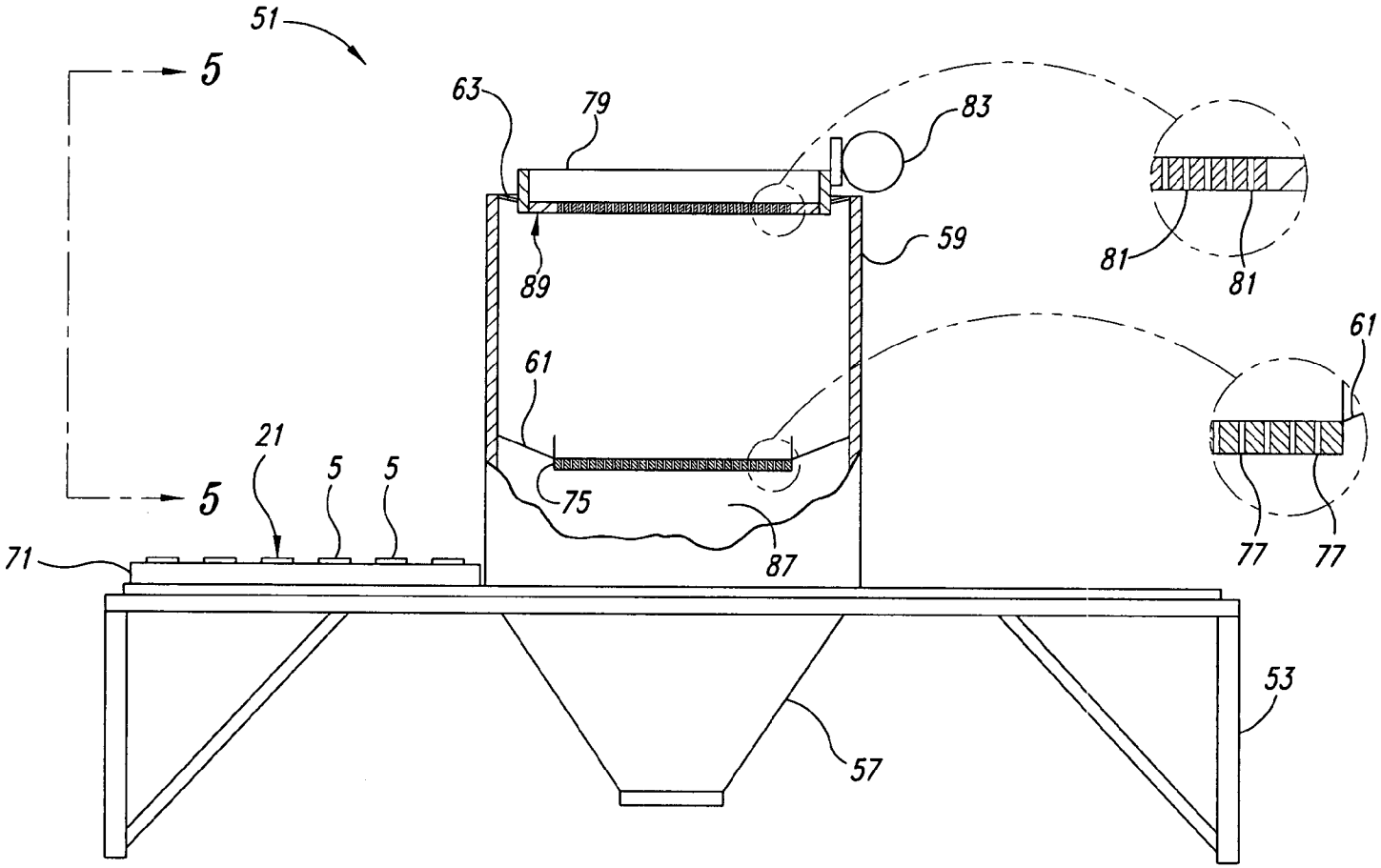
FIG. 4 is a side view of a system for applying textile fibers to a shoe outsole with a wall of the transfer station partially removed.
Figure 5:
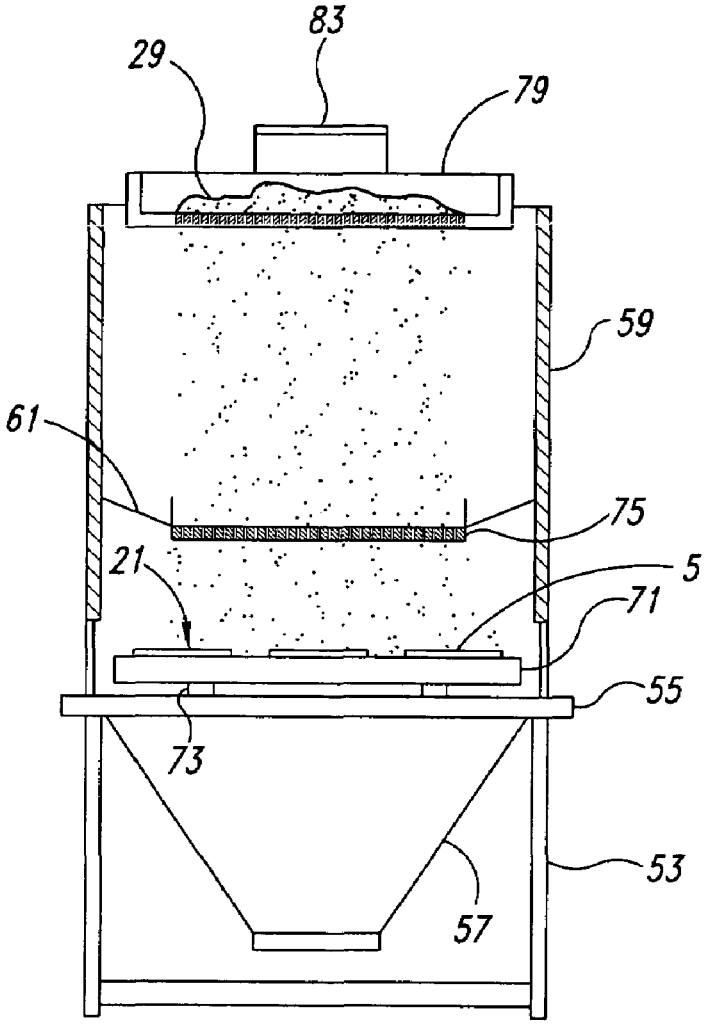
FIG. 5 is an end view schematically illustrating the method for applying fibers to the bottom surface of a shoe outsole with a wall of the transfer station removed for clarity.
Figure 6:
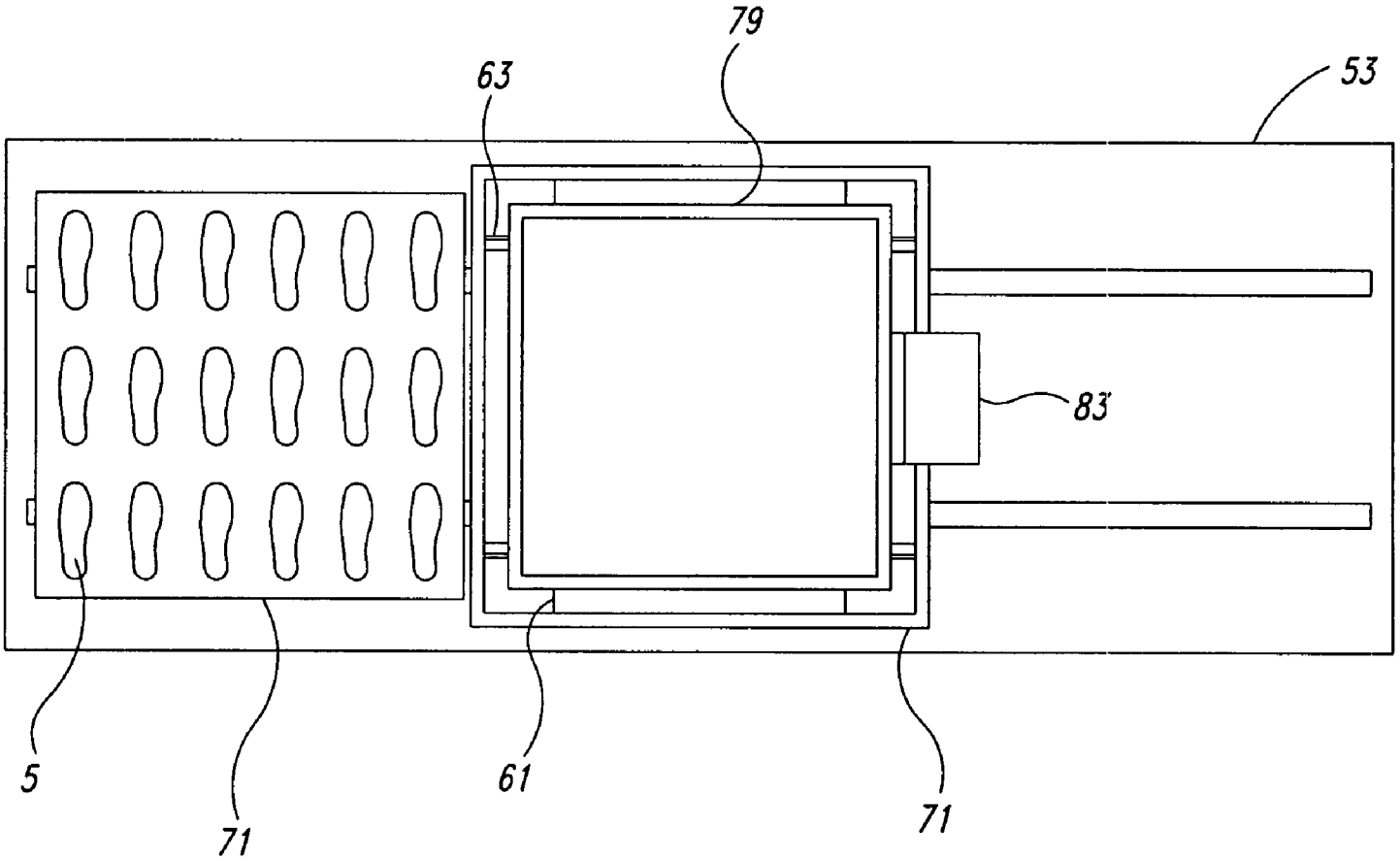
FIG. 6 is a plan view of the system for applying fibers to a shoe outsole.

FIGS. 4–6 illustrate the overall system 51 for attaching fibers 29 (FIG. 5) to the bottom surface 21 of the shoe outsole 5. The system 51 is primarily comprised of a support structure 53, a support plate 71, a transfer station 59, a conductive screen 75, and a sifting device 79.

The support structure 53 may be a bench with a flat, top surface 55. The top surface 55 may have a conveyor belt or tracks to transfer the conductive plate 71 containing the shoe outsoles 5 into and out of the transfer station 59. Attached to the support structure 53 and below the transfer station 59 may be a recycle funnel 57 for receiving fibers 29 that did not become embedded into the adhesive 27 during a fiber application process.

The support plate 71 acts as the support means 71 for supporting the shoe outsoles 5. The movement of the support plate 71 into and out of the transfer station may be accomplished in a number of standard ways, such as by conveyor belt or by rollers 73 (FIG. 5) attached to the bottom of the support plate. The support plate 71 may support a plurality of shoe outsoles 5 and is preferably grounded.

The transfer station 59 forms a compartment that houses the conductive screen 75 and the sifting device 79. The bottom portion of the transfer station 59 may have an opening to allow the support plate 71 to be moved in and out.

The conductive screen 75 provides the charging means for electrically charging the fibers 29 that pass through. The conductive screen 75 may be attached to the transfer station 59 with corner brackets 61. The conductive screen 75 contains a plurality of perforations or slots 77 through which the fibers 29 pass during the fiber application operation. Additionally, a power supply may be connected to the conductive screen 75. When the power supply is turned on to the conductive screen 75, an electric field region 87 is generated between the conductive screen 75 and the conductive plate 71.

The sifting device 79 provides the sifting means for distributing at least some of the fibers 29 to the shoe outsoles 5. The sifting device 79 may be attached to the transfer station 59 with insulated brackets 63. The insulated brackets 63 isolate the sifting device 79 from the electrical circuit created when power is supplied to the conductive screen 75 which may be attached to the transfer station 59 with metal brackets. The sifting device 79 may be a box configuration with an open top for adding fibers 29. Coupled to the sifting device 79 may be a sifting motor 83 to actuate the sifting device 79. The bottom surface 89 of the sifting device may be a fine mesh screen with a plurality of perforations 81. The type of screen used for a given application will depend on the type of fibers 29 being sifted. The only requirement for the perforations 81 in the sifting device 79 is that the perforations 81 be adequately sized to permit a desirable flow rate of the fibers 29 from the sifting device 79 while avoiding continuously clogged perforations 81, but not permitting the fibers 29 to depart the sifting device 79 too quickly. The fibers 29 typically utilized in the embodiment described herein may be made from either nylon or rayon fabric, for example.

FIG. 5 schematically illustrates the fiber application operation. One skilled in the art will understand that the method of the present invention may have additional steps or that the steps of the process do not have to occur in the order discussed herein. The method of applying fibers 29 to the bottom surface 21 of the shoe outsole 5 may begin by separating the bottom surface 21 into two distinct regions, 23 and 25. The first region 23 will eventually be coated with fibers 29. However, a second region 25 must first be masked off with tape or other suitable material to form a border 33 (FIG. 3) where any applied adhesive 27 would not overlap. There is no requirement that any portion of the bottom surface 21 actually be masked off. It is conceivable that the entire bottom surface 21 could be coated with fibers 29; therefore the first region 23 would be equivalent to the entire bottom surface.

Once the second region 25 has been masked off, adhesive 27 may be applied to the first region 23. The adhesive 27 may be brushed onto the first region 23. A type of adhesive 27 that may be used could be of a type that is curable when subjected to higher than room temperature for a sufficient amount of time, typically 1–2 minutes.

The shoe outsoles 5, after being masked off and having the adhesive 27 applied, may be set upon a support plate 71 with the bottom surface 21 of the shoe outsole 5 facing upward. However, it should be noted that the shoe outsoles 5 may be set upon the support plate 71 before the masking and adhesive application steps. The support plate 71 containing the prepared shoe outsoles 5 may then be moved into the transfer station 59 such that the support plate 71 comes to rest directly under the conductive screen 75. The movement of the support plate 71 into the transfer station 59 may be accomplished either manually or automated with a track and roller or a conveyor belt system.

The conductive screen 75 supported within the transfer station 59 may be powered up; thus creating an electrical circuit with the conductive screen 75, the transfer station 59, and the support plate 71. An electric field region 87 is created between the conductive screen 75 and the support plate 71, thereby encompassing the prepared shoe outsoles 5. The power supplied to the conductive screen 75 may be from a generator putting out 500 to 1000 Watts, for example.

With the electric field region 87 established, the fibers 29 contained in the sifting device 79 may be sifted through the perforations 81 contained therein. The sifting of the fibers 29 may be accomplished manually (i.e., shaken by hand) or automatically through a sifting motor 83 coupled to the sifting device 79. In either event, as the fibers 29 pass through the perforations 81 of the sifting device 79, the fibers 29 are gravitationally directed toward the conductive screen 75 located directly below.

The conductive screen 75 being perforated or slotted 77, permits the fibers 29 to pass through virtually unobstructed. Upon passing through the conductive screen 75, the fibers 29 become electrically charged. The charged fibers 29, upon entering the electric field region 87, become substantially aligned with the electric field such that the charged fibers 29 are approximately vertically oriented. The charged fibers 29 maintain their vertical orientation upon contacting the adhesive 27 on the bottom surface 21 of the shoe outsoles 5. The orientation of the shoe outsole 5 as supported on the support plate 71 dictates the resulting angle of the fibers 29 with respect to the bottom surface 21. This angle may be varied depending on the look desired. The charge in the fibers 29 is dissipated upon contact with the adhesive 27 or the support plate 71. Any loose fibers 29 may be shaken off the outsoles 5 into the recycle funnel 57. Additionally, any fibers 29 that did not become embedded into the adhesive 27 are also directed into the recycle funnel 57. The process recited herein takes approximately 5-10 seconds from the moment sifting begins until the bottom surface 21 of the shoe outsoles 5 are sufficiently coated with fibers 29.

The support plate 71 supporting the shoe outsoles 5 may then be transported to a heating device (not shown), such as a standard oven typically found in a shoe factory, to cure the adhesive 27 containing the embedded fibers 29. However, it is not required that the shoe outsoles 5 remain on the support plate 71. The shoe outsoles 5 may be transferred to a separate tray before being placed in the oven. An adequate adhesive 27 curing temperature for the oven is approximately 120 degrees Celsius. The shoe outsoles should be at the curing temperature for approximately 1–2 minutes to achieve sufficient curing or hardening of the adhesive 27.

Lastly, the shoe outsoles 5 may be cooled and then treated with an anti-slip solution applied to the first region 23 (i.e., the textile coated region). The anti-slip solution may be applied by spraying the bottom surface 21. Once the anti-slip solution has sufficiently dried, the shoe outsoles 5 may be affixed to a shoe upper 3 in the standard production flow of a shoe 1 processing line.

The present invention provides an inexpensive method of creating a visually appealing shoe 1. Such a process could be automated to process many outsoles 5 simultaneously as shown in FIG. 6. There are no special molds or mold designs required to produce the outsoles 5 and no special procedures for shoe production after the fiber application process has been completed.

Figure 7:
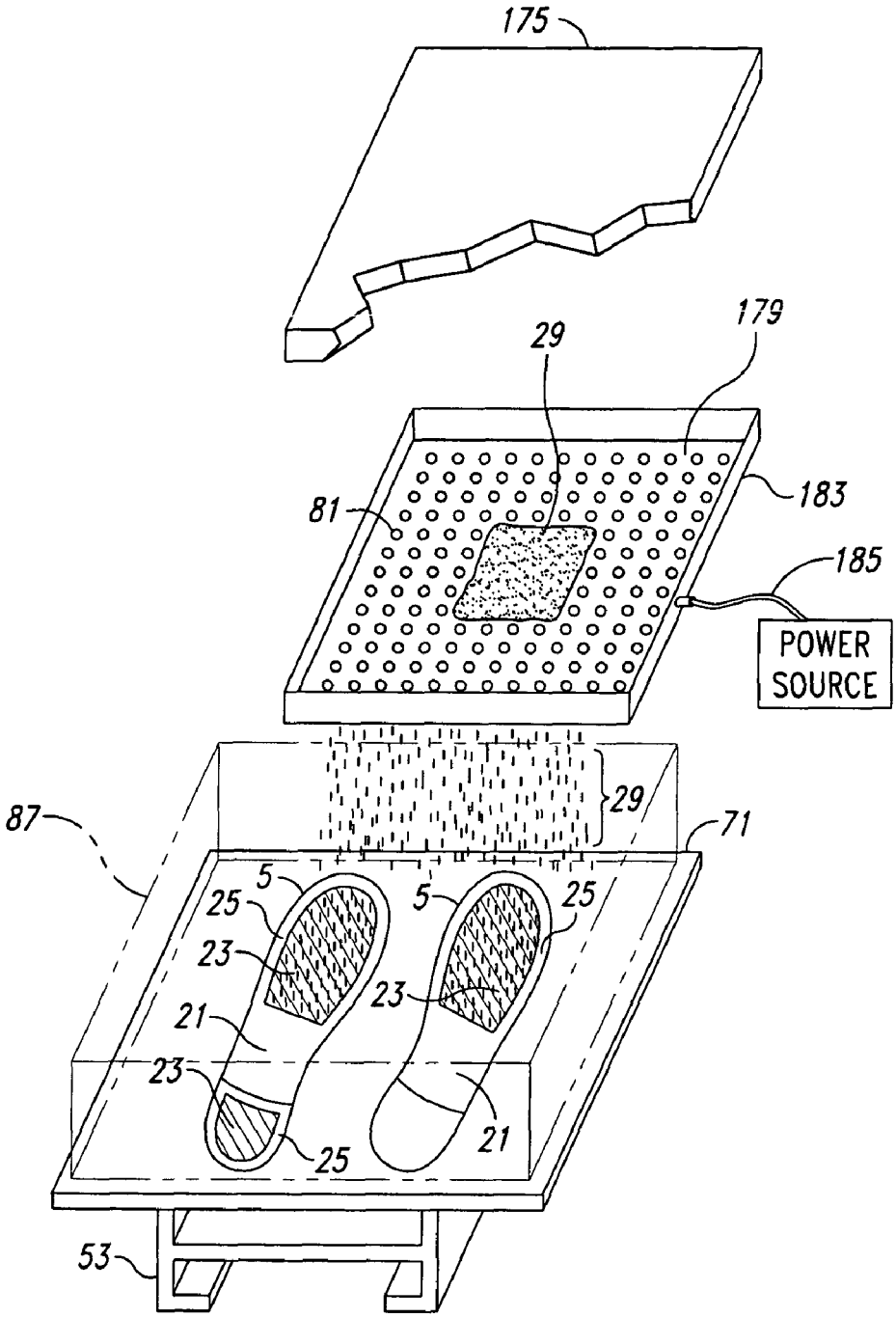
FIG. 7 is an exploded view of an alternate embodiment of the system for applying fibers to a shoe outsole.

FIG. 7 illustrates an alternate embodiment of the invention for attaching fibers 29 to the bottom surface 21 of a shoe outsole 5. The alternate embodiment is primarily comprised of a support structure 53, a support plate 71, a cover plate 175, and a conductive screen 179. Additionally, the alternative embodiment does not require the use of a transfer station 59 as the movement of the shoe outsoles 5 into and out of the electric field 87 may be accomplished manually. Only the details of the alternate embodiment that have a substantially different structural form are described herein.

As shown in FIG. 7, the alternate embodiment uses a screen 179 containing a plurality of perforations 81 through which the fibers 29 pass during the fiber application operation.

A screen 179 may be charged to create the electric field 87 between the screen 179 and the support plate 71. The power source 185 to the screen 179 may be from a generator putting out 500 to 1000 Watts, for example.

Although several structural details in the alternate embodiment have been varied, the overall fiber application operation is substantially the same as the previous embodiment with the only difference being that the fibers 29 may be pre-sifted onto the screen 179 to provide a more uniform fiber application. Accordingly, with the electric field region 87 established, the fibers 29 contained on the screen 179 become charged due to their contact with the screen 179. The charged fibers 29 are subsequently drawn through the perforations 81 contained within the screen 179 as the screen is manipulated with the attached cover plate 175. The cover plate may be made from any non-conductive material. As the charged fibers 29 pass through the perforations 81 of the screen 179, the charged fibers 29 are gravitationally directed toward the grounded support plate 71 located directly below and also become vertically aligned with the electric field 87.

A significant advantage of the resulting product, a shoe 1 with at least a portion 23 of the outsole 5 being coated with fibers 29, is that the retailers are provided with a new, innovative and aesthetic feature that can be used to attract consumer attention to the product. Because the fibers 29 may be matched or artistically contrasted with the color of the shoe 1, or even provide the shoe outsole 5 with a simulated leather look, the shoe retailers now have a wider range of options on how and where to display the shoes. Additionally, the appearance of the outsole 5 with at least a portion 23 coated with fibers 29 provides the impression of value in a competitive shoe market.

The bottom surface 21 of the outsole 5 coated with fibers 29 does not limit or degrade the functional performance of the shoe 1. An outsole 5 with a fabric coated sole of the present invention provides an equivalent amount of protection from the elements as a non-coated sole.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A method for applying fibers to a shoe outsole, the method comprising:

applying an adhesive to a first region of a bottom surface of the shoe outsole;

placing the shoe outsole on top of a support plate, the bottom surface facing upward;

providing a screen above the support plate;

creating an electro-static field in a region above the support plate;

drawing a plurality of fibers through the screen wherein the fibers are charged and gravitationally drawn toward the support plate due to the electro-static field region, the fibers continuing downward through the electro-static field region until at least some of the fibers become embedded into the adhesive;

removing the support plate with the shoe outsole; and curing the adhesive with the embedded fibers therein.

2. The method of claim 1 wherein a second region of the bottom surface of the shoe outsole is masked off before applying the adhesive.

3. The method of claim 1 further comprising a sifting device located above the screen wherein the electric field region is created between the screen and the support plate and the fibers are sifted downward toward the screen.

4. The method of claim 3 wherein power is supplied to the screen before the support plate is placed under the conductive screen.

5. The method of claim 3 wherein the fibers are electrostatically charged as they pass through the screen and thereafter become substantially aligned with the electrostatic field.

6. The method of claim 3, further comprising a sifting motor coupled to the sifting device for actuation thereof.

7. The method of claim 1 wherein the fibers, upon impact with the adhesive, are substantially normal to the first region of the bottom surface of the shoe outsole.

8. The method of claim 1 wherein the curing of the adhesive is accomplished by placing the support plate with the shoe outsole into an oven.

9. The method of claim 1, further comprising the support plate having a plurality of rollers for moving the support plate under the screen.

10. The method of claim 1 wherein the fibers are comprised of textile material.

* * * * *